US005280893A

United States Patent [19]

Sixtensson

[11] Patent Number: 5,280,893

[45] Date of Patent: Jan. 25, 1994

[54] FIXTURE FOR HOLDING ONE OR MORE ARTICLES

[76] Inventor: Roland Sixtensson, Virkesvagen, S 574 00 Vetlanda, Sweden

[21] Appl. No.: 67,168

[22] Filed: May 26, 1993

Related U.S. Application Data

[63] Continuation of Ser. No. 751,199, Aug. 29, 1991, abandoned.

[30] Foreign Application Priority Data

Aug. 30, 1990 [SE] Sweden ..... 9002770-7

[51] Int. Cl.[5] ..... B25B 1/00

[52] U.S. Cl. ..... 269/154; 269/37; 269/43; 269/234

[58] Field of Search ..... 269/37, 40, 42, 43, 269/44, 45, 153, 154, 156, 234

[56] References Cited

U.S. PATENT DOCUMENTS 4,208,045 6/1980 Rowe et al. ..... 269/100
4,930,760 5/1990 Mirkovic ..... 269/99
5,094,436 3/1992 Stephan, III ..... 269/43

FOREIGN PATENT DOCUMENTS 0328792 8/1989 European Pat. Off. .
4123492 4/1992 Fed. Rep. of Germany .
2178985 2/1987 United Kingdom .
8904236 5/1989 World Int. Prop. O. .

*Primary Examiner*—Bruce M. Kisliuk
*Assistant Examiner*—Eileen P. Morgan
*Attorney, Agent, or Firm*—Cushman, Darby & Cushman

[57] ABSTRACT

The invented fixture consists of a double acting jaw with a fixed part (F) and a movable part separated in two (R1 and R2), where the latter can slide along slide surfaces (8 and 9) on the fixed jaw for example by the use of a screw (A). The fixed jaws are oriented to a frame or jig by the use of for example anchoring bolts (B) on each side of work pieces (1). The orientation along balks or slots is performed by pins (C) through fixed jaws and balks or a jig through holes arranged - equidistant in the balks and in different combinations in the fixed jaws.

8 Claims, 1 Drawing Sheet

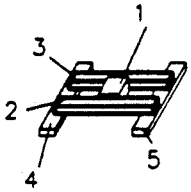
Fig. 1A
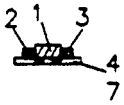
Fig. 1B
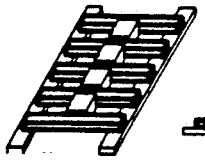
Fig. 2A
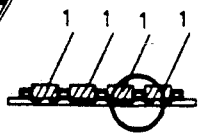
Fig. 2B
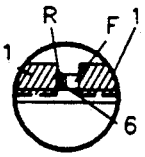
Fig. 3A
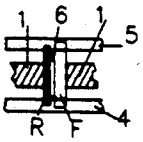
Fig. 3B
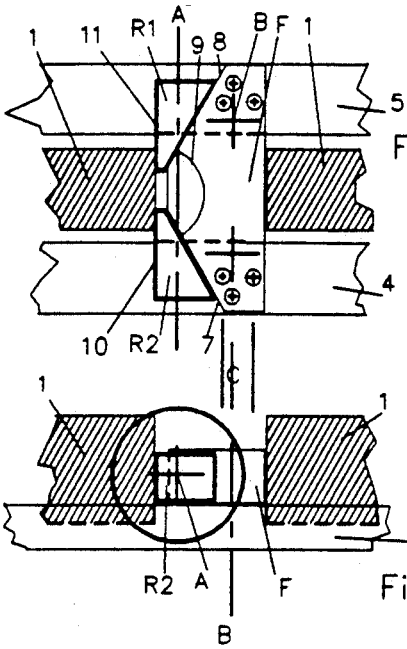
Fig. 4A
Fig. 4B
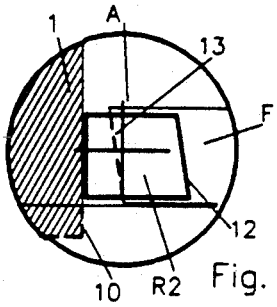
Fig. 4C
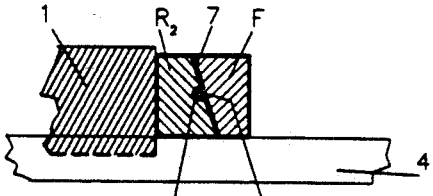
Fig. 7
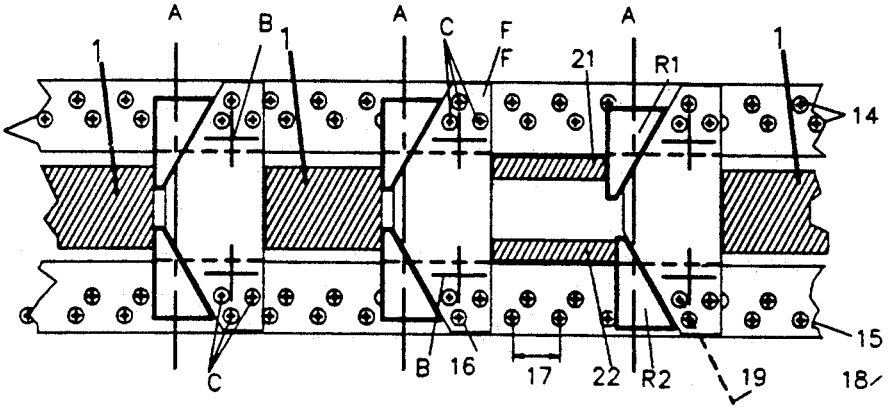
Fig. 5
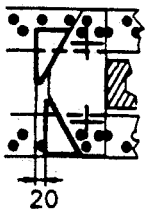
Fig. 6

FIXTURE FOR HOLDING ONE OR MORE ARTICLES

This is a continuation of application Ser. No. 07/751,199, filed on Aug. 29, 1991, now abandoned.

TECHNICAL FIELD

Modern machining equipment like cutters and drilling machines are normally controlled by such devices, that several work pieces have to be set up simultaneously to get a profitable handling. A condition for that is that all pieces will be oriented in the equipment in a way that permissible variation is kept under control. Essential is that the mounting of the pieces can be made rapidly, and that change of pieces after treatment also can be made in a short time.

It is in this technical field the present invention leaves a solution of the problem of firstly orientings number of fixtures in a certain equipment, secondly make it possible to install those fixtures in a way that makes it possible to rapidly release work pieces and that the instalment is so reproducible that it can be used in numerically controlled machine tools.

BACKGROUND ART

In an ordinary screw vice one has solved the problem by a simple instalment of a work piece between two jaws. Usually one of the jaws is fixed and one is movable through some kind of guided operation, that leads to a clamping of the piece between the jaws.

The problem now is to arrange a number of fixed double acting screw vices on a working table or jig so that location of the fixed jaws will be described in a way, that the orientation can be used as coordinates in a numerically controlled machine, which will become reproducible when mounted in the machine.

DISCLOSURE OF INVENTION

The invention consists of a simple unit or modular plate, that in a know way can be oriented and mounted in a converting machine. Such units very often are called jigs or fixtures. In the following is meant by a jig a unit with several fixed and movable jaws. A jig might consist of two beams with a slot for one anchoring pin in each beam. But the jig might also consist of a plate, modular plate with slots and orienting holes for a coordinate location. It is most characteristic for the invention that work pieces will become clamped in a jig between one fixed jaw and one movable. One movable jaw will be found on the back of a fixed jaw and is movable in relation to that fixed jaw.

The solution of the problem thus consists placing a number of screw jaws reproducible in a jig. The latter should then be mounted in some machine in a known way.

It is characteristic of the invention that the fixed jaw is oriented in the jig or the machine by dowel pins. Different combinations of holes in the fixed jaw can be orientated against other holes in the jig or the working frame of the machine like two beams.

It is a further characteristic of the invention that the clamping force from the movable jaw comes from a combination of wedges and slip planes, some of which are part of the fixed jaw and the other are part of prisms or frustum of pyramids. The latter can slide in a known way against the former. The sliding or movement can, for example, be arranged by some kind of screw union.

To prevent play and undesired movements of the movable jaw the sliding plane of the fixed jaw might be tilted or be supplied with guiding devices. In such cases the movable jaw will become clamped between the fixed jaw and the frame or beams when clamping forces are applied.

Further characteristics and modifications will be put forward in the following description of a successful arrangement.

BRIEF DESCRIPTION OF DRAWINGS

In FIGS. 1*a* and 1*b* the problem—clamping of a working piece—is presented. The problem with several pieces to be mounted in a machine is shown in FIG. 2*a* and 2*b*. In FIGS. 3*a* and 3*b* is shown from above and from the side how it is possible to let a free and a fixed clamp form a unit.

The invention is shown in FIGS. 4*a*, 4*b* and 4*c*. Several double jaws for several working pieces are shown mounted in FIG. 5. A certain advantage with double jaws is also shown. Finally the problem with graduation of holes and jaw movement is shown in FIG. 6. FIG. 7 is the side view in elevation showing the tongue and groove interfitting between a slide member and a fixed jaw.

ONE MODE FOR CARRYING OUT THE INVENTION

The establishment of the problem shown be clear from the FIG. 1. In this figure a work piece 1 is fastened between two jaws 2 and 3. Those jaws are in turn mounted on two balks or beams 4 and 5, which form a jig. The mounting can be performed in many ways. One successful way is to use anchoring bolts if the balks have slits like on a milling table. This can be seen schematically in perspective on FIG. 1*a* and from the side in FIG. 1*b*.

Several work pieces can be mounted simultaneously in series between jaws as FIG. 2 shows. In this figure four pieces have been clamped in the same way as in FIG. 1. In the following the pieces will be shown hatched even if the are not shown in section. The hatching is supposed to make it easier to distinguish jaws from work pieces in the drawings.

In the drawings different thickness of the lines have been used to separate different units from each other.

The present invention presents an arrangement on each jaw, which makes it double acting with a fixed jaw in one direction and a movable jaw in the opposite. The mounting of the fixed jaw on some frame is also an important part of the invention.

From the FIG. 2*b* a region between two work pieces has been enlarged in FIG. 3*a*. In this enlargement two work pieces 1 can be observed. Between them one fixed jaw F and a movable jaw R can be seen. Between those there is a component 6 used to move the movable jaw relative to the fixed jaw F. The arrangement seen from the side in FIG. 3*a* is shown from above in FIG. 3*b*.

One can observe that the fixed jaw F reaches over the two balks 4 and 5 in the jig, which makes a steady anchorage of the fixed jaw F to a machine's frame via the balks or directly through slits in for example a milling table, where parts of slits in a known way can be built in the balks. Those anchoring components for fastening of a balk on a machine frame or in a jig are known by men skilled in the art and are not part of the invention.

Some of the characteristic details are shown in FIG. 4. From those can be seen from above in FIG. 4*a* a fixed jaw F and one in two parts (R1 and R2) cut movable jaw. This unit separates two work pieces 1 and 1A.

The fixed jaw has the shape of a blunt arrow with two slip planes 7 and 8, forming an angle with each other. The point of the arrow is symmetrically situated between the two mounting balks 4 and 5 or slits in a jig.

Along those planes the two parts of the movable jaw can slide. The movable jaw in this figure consists of two prisms (R1 and R2) with three sides in section forming strait angles with each other and a fourth tilted against two. A section of the prisms form trapezoids. The tilting of the fourth is essentially half of the arrow formed angle 9 of the fixed jaw. With a screw A, the centrum line of which is marked in the figure, it is possible to force the two prisms to or from each other in a known way. The prisms will during this slide against the slide planes 7 and 8 of the fixed jaw in a way that their front surfaces 10 and 11 will be moved essentially in parallel to the direction of the balks 4 and 5. Other methods to apply clamping forces are known by persons skilled in the art.

The two prism shaped blocks R1 and R2 and the arrow shaped fixed jaw are characteristic for the present invention. The prisms are linked to the fixed jaw in some known way. It has shown advantageous that the prisms slide against some frame like the balks 4 and 5 one for each prism shaped R1 and R2. Naturally the blocks R1 and R2 can slide on a flat surface with slits for anchoring bolts as the balks only symbolize an attachment to a machine or in a jig. This is shown from the side in FIG. 4*b*. The centre of the screw A is also marked. To reduce the risk of tilting over for the prisms it has been shown advantageous to use frustums of pyramids instead of straight prisms, which is shown in FIG. 4*c*.

Here a part of the arrangement in FIG. 4*b* has been modified. The modification consists in such a tilting of the slide planes 7 and 8, that those form an angle less than straight with the frame, and that the pyramids has been given corresponding tilts on one side. This is clearly shownin FIG. 4*c* with the tilting line of contact 12 between arrow point and frustum of a pyramid. The contour of the hidden point 13 is also indicated. The previous parallel moving of the front surfaces 10 and 11 of the prisms is now modified in a way that the pyramides become pressed against the bottom frame because of a small wedge effect between the point of arrow and the earlier prisms. The front surfaces 10 and 11 form as previously straight angle with the bottom frame.

The slide surfaces 7 and 8 against R1 and R2 can also be supplied with guiding lips or slits, which prevent tilting over of the pyramids or prisms.

With the latter modification a more secure clamping of work pieces 1 against the front surface of a movable jaw is provided compared to a suspended movable jaw or a jaw on guide rods.

The fixation of the fixed jaw F on the balks 4 and 5 is in a successful application performed with two anchor bolts B through the fixed jaw and movable in slits in the balks. This is not shown in the figures as it is a well known technique. The center of the anchoring bolts or some other known method to removable and sliding along a balk fasten the fixed jaw to a balk or on a working table is indicated with the center hole in the FIGS. 4, 5 and 6.

In FIG. 5 some work pieces 1 and two pieces 21 and 22 are clamped. What really should be studied in detail are the two in the middle of the figure. Three pair of jaws F, R1 and R2 are needed to clamp two pieces. Here the pieces 21 and 22 can be clamped with some difference in length.

On each side of the work pieces 1 in FIGS. 4*a* and 4*b* there are three holes C shown in the fixed jaw F. Those holes can also be found in the FIGS. 5 and 6. In FIG. 5 one can also observe two rows of holes in each balk. The latter holes are sometimes covered by the jaws F, R1 and R2.

The combination of the holes C in the fixed jaws and the row of holes 14 is an other characteristic of the invention. Concentrating on the bottom row 15 in one of the balks and the bottom hole 16 in the fixed jaw the person of ordinary skill in the art understands that the fixed jaws can be placed on equidistance from each other, a distance that is determined by the distance 17 between the holes in the balk. It is thus easy to mount fixed jaws at predetermined distances from each other.

With big holes, like for example 10 mm diameter, a reproducible and durable orientation of the fixed jaws on the balk 4 and 5 or in a jig can be achieved with the help of a pin through jaw and balk. When a number of jaws have been orientated along the balks, those can be fastened to the latter by some known method like with anchoring bolts B.

The possible variation of place for the fixed jaws is determined by the distance 17 between the holes 15 in the balks. An increased flexibility can be obtained with two rows of holes in the balks and another two holes on each side of the fixed jaws. If a line 18 through the center of the holes in a balk and another line 19 through center of corresponding holes in the fixed jaws cut each other the flexibility of orientation of the fixed jaws along the balks is still increased. A third hole suitably placed on each side of the fixed jaw might increase the flexibility further.

One aim at a solution such that the periodicity of the orientation along the balks 4 and 5 or in the jig is less than the clamping amplitude 20 or movability of the frustum pyramids R1 and R2. This is shown in FIG. 6 where one of the pyramids is at its very from position and the other in it drawn in position. The fixed jaws F can then be placed along the balk or in the slots of the frame in such a way that variation in length of the work pieces caused by cutting for example can be met with by the movable jaws R1 and R2.

The two movable jaws also allow a clamping of a pair of workpieces 21 and 22. Some variation in length from the cutting for example might also be taken care of, as the movable jaws R1 and R2 can slide along the surfaces of the fixed jaw independent of each other. This is shown as an extra example in FIG. 5.

The present invention as shown in FIG. 4C that the slide surfaces of the slide members R1 and R2 are tilted at an angle to the surface of the balk 4 and 5. In addition, the slide planes 7 and 8 are tilted at the same angle. With this arrangement, when a clamping force such as from a work piece 1 or 1A is imposed on the facing surface of a slide member R1 or R2, the slide member will be locked in position by being wedged between the surface of the balk 4 or 5 and the slide surface 7 or 8. Additionally, the slide surfaces may be provided with tongue and groove formations 24, 25 to facilitate the locking function when a clamping force is applied by the pressure of the work piece 1 or 1A as shown in FIG. 7. The tongue and groove will, of course, extend in the direction of sliding motion of the parts R1 and R2.

The person of ordinary skill in the art understands that the mentioned arrangement only aim at an orientation of different work pieces in one direction, which coincide with those of the balks or the slots. For an orientation across the balks skilled men know several types of overhangs or projections against which the pieces should be brought before they become clamped in the perpendicular direction.

The fixed jaws as well as the movable pyramides can in a known way be furnished with guiding projections like grooves or angle fixing tools for round pieces. The projections might also have a groove in the upper part to be used with thin pieces, but those arrangements are well known and are not included in the invention. The person of ordinary skill in the art observes in the figures that the work pieces 1 have been given a height such that they partly end up between the balks 4 and 5. This is just an example, that illustrates a possibility if the pieces have a large height and the fixation of the jaws really is performed on balks with different rows of holes 14.

An opening in depth will thus also be considered in the following claims.

The person of ordinary skill in the art understands that steel is a suitable material for the manufacturing of movable as well as fixed jaws and the guiding pins C, which are used for the orientation. Other hard material should also be considered within the scope of the claims. Some soft material might be needed in the protrusions if the finish of the work pieces is sensitive.

INDUSTRIAL APPLICABILITY

The present invention gives a solution of the problem of reproducible fasten work pieces for treatment in numerically guided machines and the like. The arrangement is mainly aiming for reduction of adjusting and set up times leading to a compression of the total time pro piece for treatment. The invention thus has a large industrial usefulness.

What is claimed is:

1. A support having means for positioning an article in place relative to said support, said means for positioning comprising a first and a second member each having a portion fixed to said support with said members being spaced apart a selected distance from each other on said support, said support having a first end and an opposite, second end, said first and second members each including a first side facing one of said ends and a second side facing the opposite said end of said support, said first side of each member comprising a surface portion, said second side including two surfaces each extending at substantially the same angle relative to &aid surface portion, said means for positioning further including a slide member for slidably engaging each of said two surfaces of said second side, said slide members being selectively movable on said respective surfaces of said second side to vary the selected distance between the adjacent said first side of the other of said members to thereby accommodate different sized articles between said first and second members.

2. The support as claimed in claim 1, wherein said support comprises a flat surface on which said first and second members are positioned and fixed, said two surfaces of said second side of said members extending at an included angle of less than 90° relative to said surface of said support, said slide members each including a surface for engaging a said surface of said second side with said surface of said slide member extending at substantially the identical angle to said surface of said support so that said slide members will become clamped between said associated member and said support when a clamping force is applied to a said slide member.

3. The support as claimed in claim 1, wherein said two surfaces of said second side are provided with slots and said slide members include surfaces having protrusions receivable in said slots to facilitate locking of said slide members when subjected to a clamping force.

4. The support as claimed in claim 1, wherein said support comprises two parallel extending, elongated elements with said first and second members each having opposite ends with one of said ends fixed to one of said elements and the other of said ends fixed to an opposite element so as to maintain said elements spaced apart a selected distance, said first and second members being positionally adjustable on said elements by the provision of a plurality of spaced bore holes provided in said elements with said holes being arranged in pairs on each said element, each said member having bore holes alignable with at least two of said bore holes formed in each said element.

5. The support as claimed in claim 4, wherein each said member on each of its opposite ends is provided with three holes alignable with three holes on the subjacent element and fastening pins are provided for fastening each of said bore holes of each said member to an associated element.

6. The support as claimed in claim 4 or 5, wherein the displacement distance of said slide members is greater than the smallest distance between associated bore holes in said pair of elements to which a said first or second member may be fixed.

7. The support as claimed in claim 1 wherein said means for positioning includes a plurality of pairs of said first and sernd members.

8. The support as claimed in claim 4 wherein said means for positioning includes a plurality of pairs of said first and second members and each adjustably positionable on said support, said support having spaced sets of bore holes to permit selective positioning of said members on said support.

* * * * *